US005689977A

United States Patent [19]

Yorisue et al.

[11] Patent Number: 5,689,977

[45] Date of Patent: Nov. 25, 1997

[54] CIRCULAR KNITTING MACHINE WITH JACQUARD PATTERN CONTROL MECHANISM

[75] Inventors: Shozo Yorisue, Hyogo; Takao Shibata, Osaka; Shinji Hashihiro, Hyogo, all of Japan

[73] Assignee: Precision Fukuhara Works, Ltd., Japan

[21] Appl. No.: 771,519

[22] Filed: Dec. 23, 1996

Related U.S. Application Data

[63] Continuation-in-part of Ser. No. 674,017, Jul. 1, 1996.

[30] Foreign Application Priority Data

Jul. 4, 1995 [JP] Japan ..... 7-192439
Oct. 9, 1995 [JP] Japan ..... 7-287863

[51] Int. Cl.[6] ..... D04B 15/78

[52] U.S. Cl. ..... 66/219; 66/217; 66/215; 66/8

[58] Field of Search ..... 66/215–221

[56] References Cited

U.S. PATENT DOCUMENTS

| | | | |
|---|---|---|---|
| 3,534,566 | 10/1970 | Farmer et al. | 66/221 |
| 3,667,254 | 6/1972 | Paepke | 66/221 |
| 3,863,465 | 2/1975 | De Cerjat et al. | 66/219 |
| 3,972,206 | 8/1976 | Mureso | 66/219 |
| 4,715,198 | 12/1987 | Ploppa et al. | 66/219 X |
| 4,799,366 | 1/1989 | Bertagnoli | 66/219 |
| 4,989,425 | 2/1991 | Furia | 66/221 |
| 5,046,334 | 9/1991 | Maruyama et al. | 66/221 |
| 5,375,436 | 12/1994 | Fucik . | |

FOREIGN PATENT DOCUMENTS

| | | | |
|---|---|---|---|
| 0 249 203 | 12/1987 | European Pat. Off. . | |
| 0 629 727 | 12/1994 | European Pat. Off. . | |
| 1 368 366 | 12/1964 | France . | |
| 2318377 | 10/1974 | Germany | 66/219 |
| 62 299 554 | 12/1987 | Japan . | |

*Primary Examiner*—John J. Calvert
*Attorney, Agent, or Firm*—Bell, Seltzer, Park & Gibson, P.A.

[57] ABSTRACT

A circular knitting machine and a jacquard pattern control mechanism therefor is provided in which knitting instrumentalities slidably mounted in grooves in a rotating member, such as a needle cylinder, sinker cap or dial, are controlled by a rocker bar supporting member slidably mounted in each groove behind the knitting instrumentality, the rocker bar supporting member having at least one butt thereon, a rocker bar pivotally mounted on the rocker bar supporting member and having magnetically attractable sections at opposite ends thereof, a magnetic attraction device selectively attracting the magnetically attractable sections of the rocker bar to pivot the rocker bar to control the selection of knitting instrumentalities to be moved from inactive to active positions and a cam system for moving the rocker bar supporting member and selected knitting instrumentalities.

18 Claims, 12 Drawing Sheets

CIRCULAR KNITTING MACHINE WITH JACQUARD PATTERN CONTROL MECHANISM

RELATED APPLICATION

This application is a continuation-in-part of application Ser. No. 08/674,017, filed Jul. 1, 1996, and entitled "Circular Knitting Machine With Jacquard Pattern Control Mechanism."

FIELDS OF THE INVENTION

The present invention relates to circular knitting machines and more particularly to a jacquard pattern control mechanism for such circular knitting machines.

BACKGROUND OF THE INVENTION

Circular knitting machines typically include a rotating needle cylinder having vertical grooves therein, in which cylinder needles are slidably mounted for movement between active (knitting) and inactive (welt) positions. In some machines, such needles are also movable to an intermediate (tuck) position.

Single knit circular knitting machines normally include a sinker cap mounted on top of the needle cylinder for rotation with the needle cylinder. The sinker cap has radial grooves therein, equal in number and corresponding to the grooves in the needle cylinder. A sinker is slidably mounted in each groove in the sinker cap for radial movement between active (extended) and inactive (retracted) positions. To produce some knit fabrics, the sinkers are moved selectively to a plurality of different active or extended positions to bring different portions of the sinkers into cooperative relation with the needles to form different stitch loops.

Separate cam systems are provided for operating the needles and the sinkers to move the needles and sinkers between the inactive positions and the active positions or intermediate positions or combinations thereof. Typically, the needles and sinkers have operating butts thereon which coact with cam tracks to control and operate the needles and sinkers.

In order to produce a variety of relatively intricate stitch patterns in the knit fabric, jacquard pattern control mechanisms are commonly provided and used. Such jacquard pattern control mechanisms typically select certain knitting needles for movement to the active (knitting) position while maintaining the other knitting needles in the inactive (welt) position.

Most jacquard pattern control mechanisms rely on multiple jacks in the sinker cap grooves and intricate pattern selection control devices for selecting the particular jacks to operate the sinkers. One example of such a control mechanism is disclosed in Japanese patent Laid-Open No. 45755/91 (Publication No. 03045755A). Such control mechanisms operate rather slowly which limits the production speed of the circular knitting machine and the complexity of the control mechanism obstructs the visibility of the various components, making it difficult to monitor the operation of the sinkers or to feed the knitting yarns to the needles through the yarn guides, etc.

Another example of a jacquard pattern control mechanism is disclosed in U.S. Pat. No. 5,174,131. As is typical, the control mechanism is disclosed in U.S. Pat. No. 5,174,131 associated with knitting needles. Although this patent states that the control mechanism can be used to control the sinkers, no disclosure is provided as to the manner in which this control mechanism can be adapted to control the sinkers. Even in the control of the knitting needles, the control mechanism of U.S. Pat. No. 5,174,131 has several other disadvantages and deficiencies. For example, the rocker bar of the needle selection system is mounted directly on the knitting needle which has only one operating butt thereon. Additionally, the rocker bar is provided with a plurality of protruding butts for coaction with cam tracks to control the needle. If the butt of the knitting needle should become damaged, as frequently occurs, such as by knitting a yarn with a knot therein, the knitting needle will become uncontrollable, prompting the danger that one or more of the butts on the rocker bar may be broken. Further, the cam system associated with the rocker bar, as disclosed in U.S. Pat. No. 5,174,131, has a vertical cross section. Therefore, if an outside force acts on the rocker bar, the butt(s) thereon may disengage from the cam track(s).

Jacquard pattern control mechanisms must include a pattern selection device for the needles and/or sinkers. Such pattern selection devices have taken many different forms, examples of which may be found in U.S. Pat. Nos. 5,375,436; 5,241,288; 4,905,484; 3,518,845 and 3,283,541 and in Japanese Patent Laid-Open No. 299554/87. In U.S. Pat. Nos. 5,375,436; 5,241,288 and 4,905,484 and Japanese Patent Laid-Open No. 299554/87, the pattern selection devices comprise an electromagnetic device combining a permanent magnet and an electromagnet. In each of these devices, the magnetic force of the permanent magnet is cancelled or demagnetized by the electromagnet to control the knitting needles. Therefore, the magnetic force of the electromagnet must be limited to the magnetic force of the permanent magnet. In order to obtain the necessary attraction for needle selection, both the permanent magnet and the electromagnet must be large. Because of space limitations, it is therefore difficult to install the requisite number of magnets to perform the needle selection function.

U.S. Pat. Nos. 3,518,845 and 3,283,541 disclose an electromagnetic device including a plurality of electromagnets for performing the needle selection function. In these devices, two separate electromagnets are utilized, one for selecting the needles for movement to the active position and another for selecting the needles to remain in the inactive position. In practice, these electromagnetic devices are too large and very expensive.

SUMMARY OF THE INVENTION

With the foregoing in mind, it is an object of the present invention to provide a jacquard pattern control mechanism for a circular knitting machine which is equally adaptable to control of needles and sinkers and which obviates the aforementioned disadvantages and deficiencies of prior jacquard pattern control mechanisms.

It is a further object of the present invention to provide an electromagnetic selection device for a jacquard pattern control mechanism which generates a strong attraction with a relatively limited power usage and which may be located in a small, limited space.

These objects of the present invention are achieved by a jacquard pattern control mechanism which includes a rocker bar supporting member slidably mounted in the groove of the needle cylinder or sinker cap with the needle or sinker to control the needle or sinker. A rocker bar is mounted on the rocker bar supporting member for pivotal movement about a medial pivot and has at least one magnetically attractable section at each end thereof. The rocker bar is devoid of protruding butts because the end portions of the bar serve to engage at least one rocker bar controlling cam. The rocker bar supporting member has at least one butt thereon which coacts with an actuating cam.

Preferably, an intermediate member is disposed between the rocker bar supporting member and the knitting needle or the sinker. This intermediate member has at least one protruding butt thereon which coacts with an intermediate cam track.

An electromagnetic selection device is provided in operative association with the magnetically attractable sections of the rocker bar to pivot the rocker bar selectively in accordance with a predetermined pattern. Preferably, the electromagnetic selection device includes a permanent magnet and first and second electromagnets connected to respective ends of the permanent magnet in series.

BRIEF DESCRIPTION OF THE DRAWINGS

Some of the objects and advantages of the present invention having been stated, others will appear as the description proceeds when considered in conjunction with the accompanying schematic drawings, in which:

FIG. 12 is a fragmentary sectional view similar to FIG. 9 showing an intermediate retractable cam in retracted position;

DETAILED DESCRIPTION OF THE PREFERRED EMBODIMENTS

Figure 1:
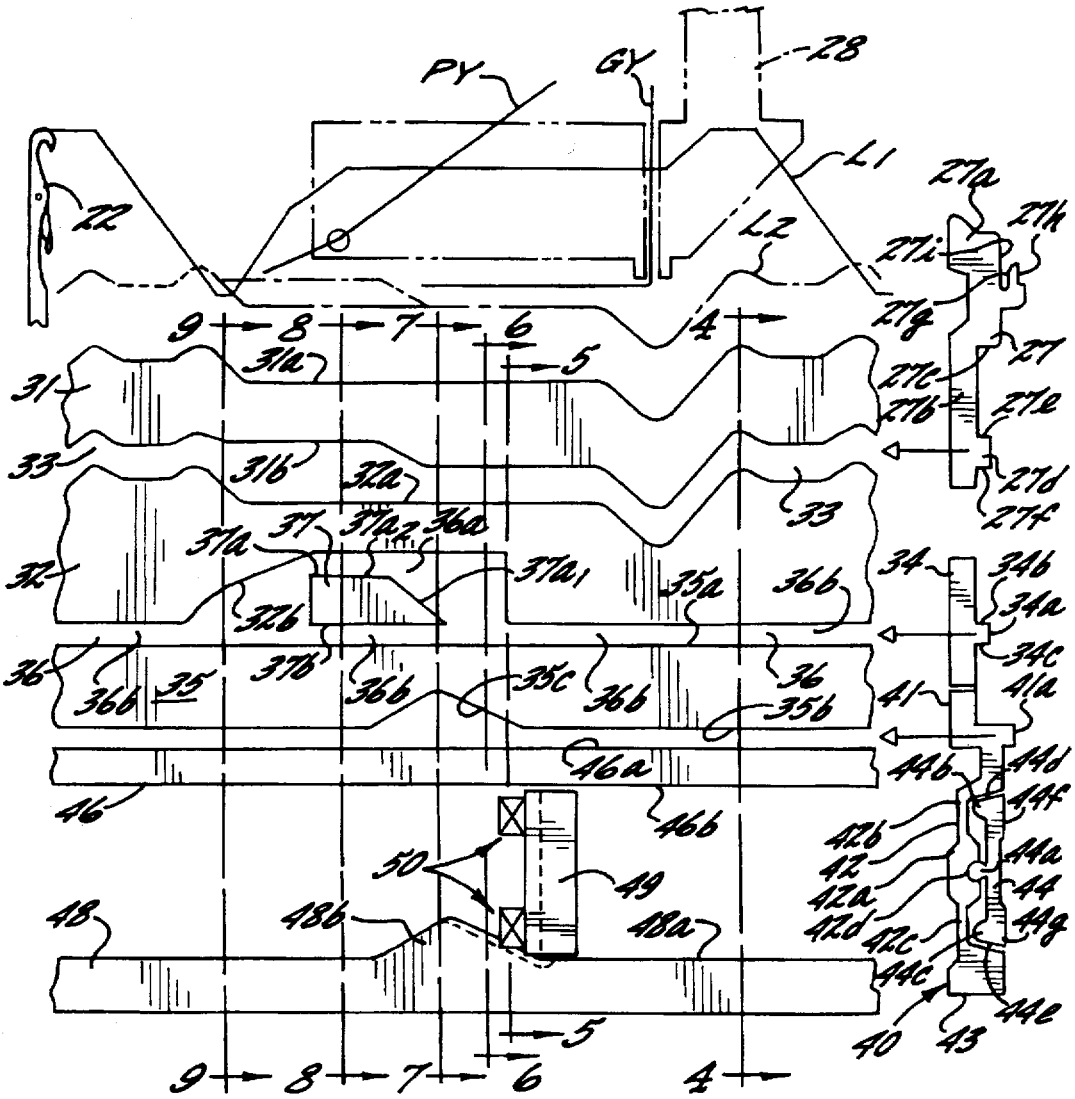
FIG. 1 is a fragmentary, schematic view of the jacquard pattern control mechanism of the present invention.
Figure 2:
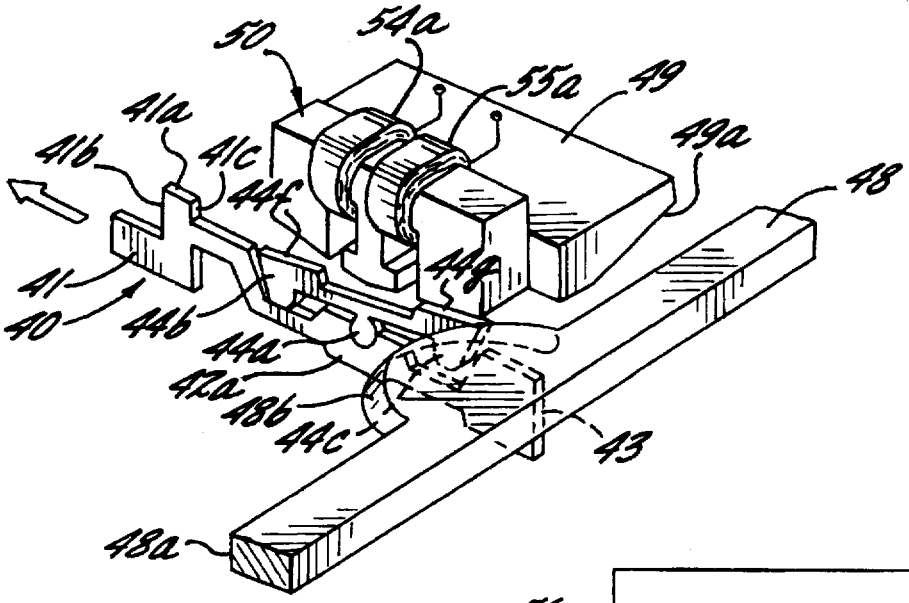
FIG. 2 is an enlarged, fragmentary perspective view of the rocker bar supporting member, rocker bar, rocker bar cam and electromagnetic selection device of the present invention.

Referring now more specifically to the drawings and particularly to FIGS. 1–7, there is illustrated schematically and sectionally the core part of a circular knitting machine, generally indicated at 20, which incorporates the jacquard pattern control mechanism of the present invention. Circular knitting machine 20 includes a rotary needle cylinder 21 having a multiplicity of grooves (not shown in FIGS. 1–7) therein. A knitting needle 22 is mounted for vertical sliding movement in each of the grooves in the needle cylinder 21.

Circular knitting machine 20 further includes a cam block 23 mounted inside the needle cylinder 21 and mounts a needle cam 24 for raising and lowering the needles 22 between an active (knitting) position and an inactive (welting) position.

A rotary sinker cap or dial 25 is mounted on top of the needle cylinder 21 and has a multiplicity of grooves 26 extending radially from the outer periphery to the inner periphery thereof. A sinker 27 is slidably mounted in each of the sinker grooves 26 for movement between an active (extended) position and an inactive (retracted) position. A sinker cam block 30 is mounted above the sinker cap 25 and mounts on its lower surface an inner sinker cam 31 and an outer sinker cam 32 in facing relation to the grooves 26 in sinker cap 25.

Sinker 27 has a main section **27*a* and an extension section 27*b*. The outer end of the main section 27*a* defines a vertical edge 27*c*. A butt 27*d* protrudes upwardly from extension section 27*b* and has vertical edges 27*e* and 27*f*. The main section 27*a* has a nose 27*g* defining a first top edge 27*h* for forming pile loops from a pile yarn PY. Main section 27*a* has a second top edge 27*i* for forming ground or non-pile stitch loops from a ground yarn GY. Pile yarn PY and ground yarn GY are fed to the needles 22 by a yarn carrier 28 (FIGS. 4–7**).

Cam 31 has a side edge **31*a* that engages the vertical edge 27*c* of sinker 27 and a side edge 31*b* which cooperates with a side edge 32*a* on cam 32 to define a cam track 33 which receives the butt 27*d* and controls sinker 27 by engagement of side edge 31*b* with vertical edge 27*e* and side edge 32*a* with vertical edge 27*f*. Cam 32 has another side edge 32*b***, the function of which will be described presently.

Figure 4:
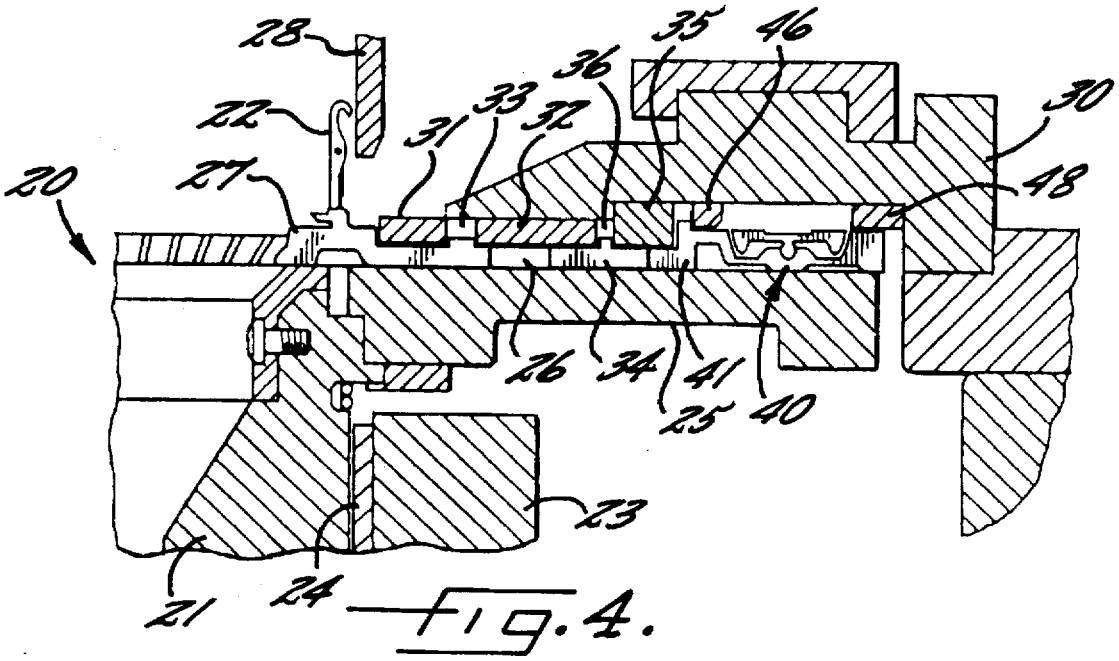
FIG. 4 is a fragmentary vertical selection view taken substantially along line 4—4 in FIG. 1.
Figure 5:
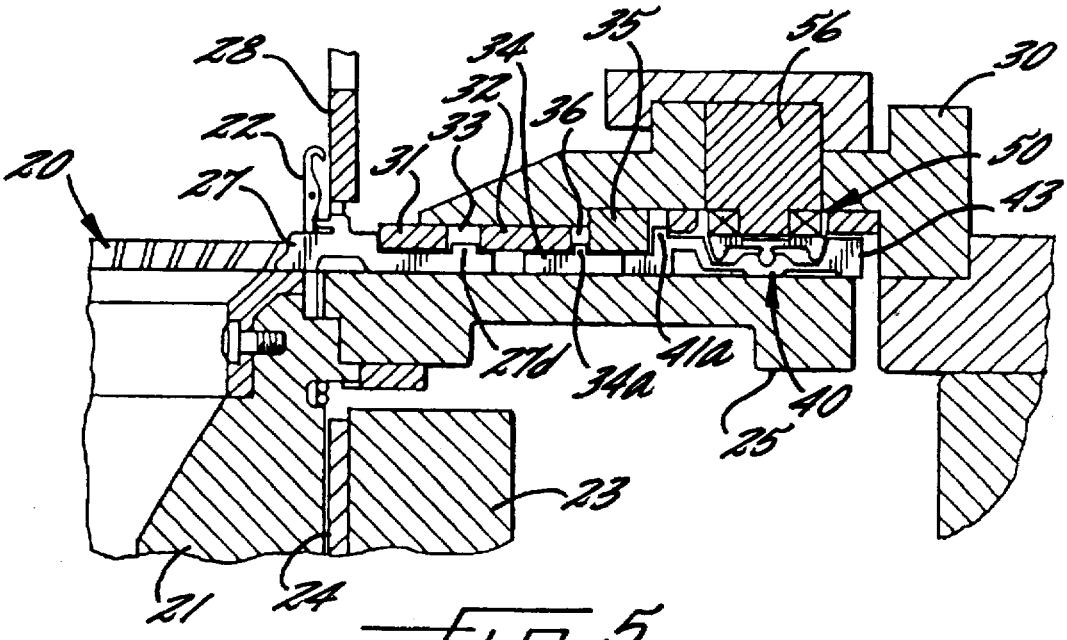
FIG. 5 is a fragmentary vertical sectional view taken substantially along line 5—5 in FIG. 1.
Figure 6A:
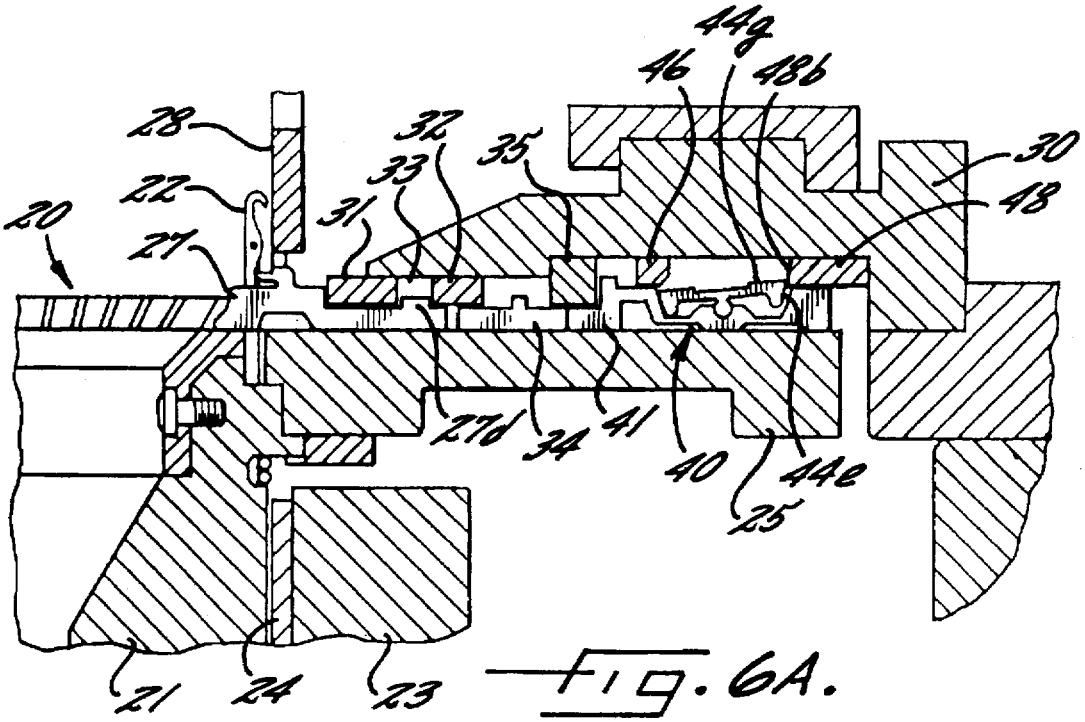
FIG. 6A is a fragmentary sectional view taken substantially along line 6—6 in FIG. 1 showing the sinker and jacquard pattern control mechanism in pile forming selection.
Figure 6B:
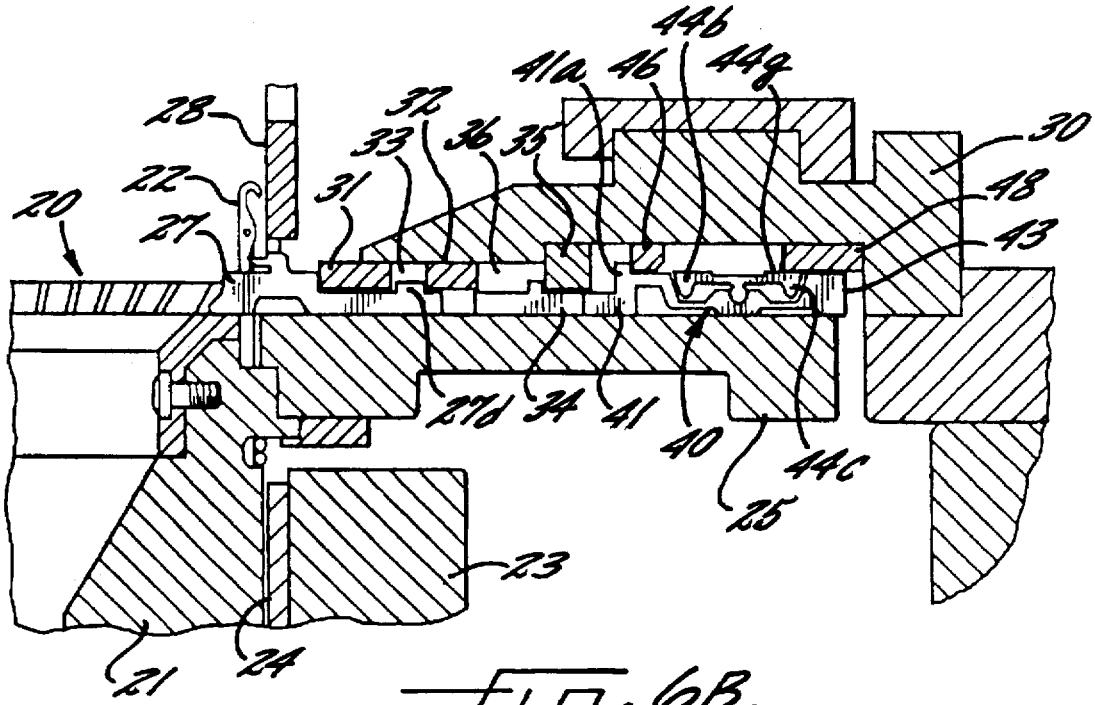
FIG. 6B is a view similar to FIG. 6A showing the sinker and jacquard pattern control mechanism in non-pile selection.
Figure 7A:
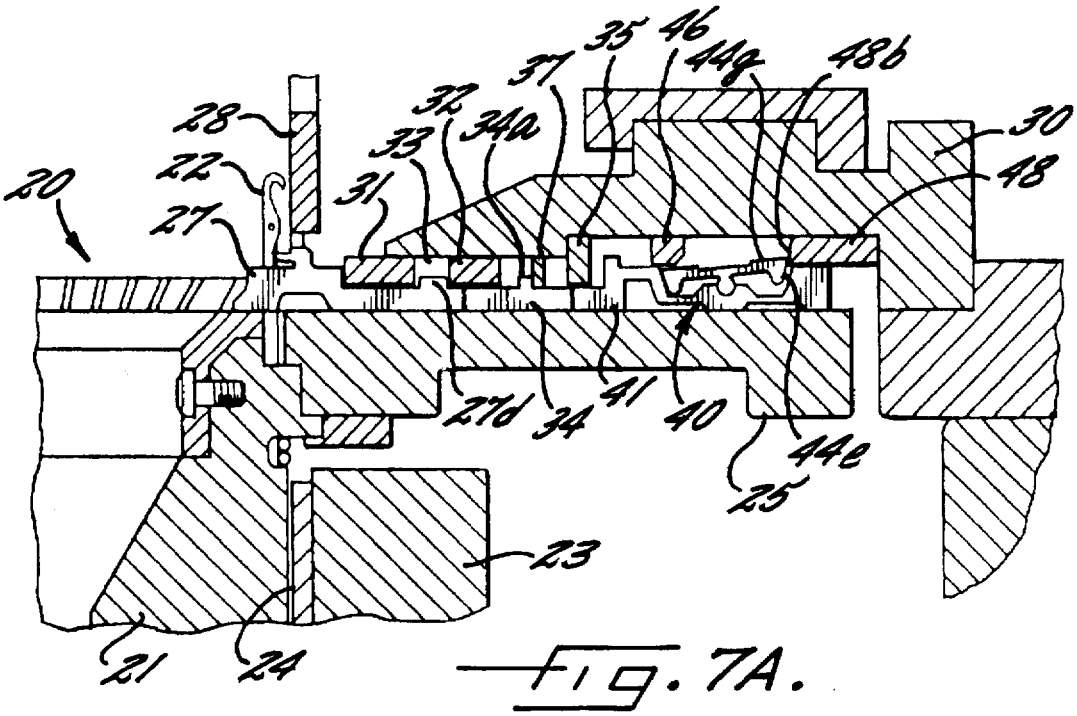
FIG. 7A is a fragmentary sectional view taken substantially along line 7—7 in FIG. 1 showing the pattern control mechanism in pile forming selection.
Figure 7B:
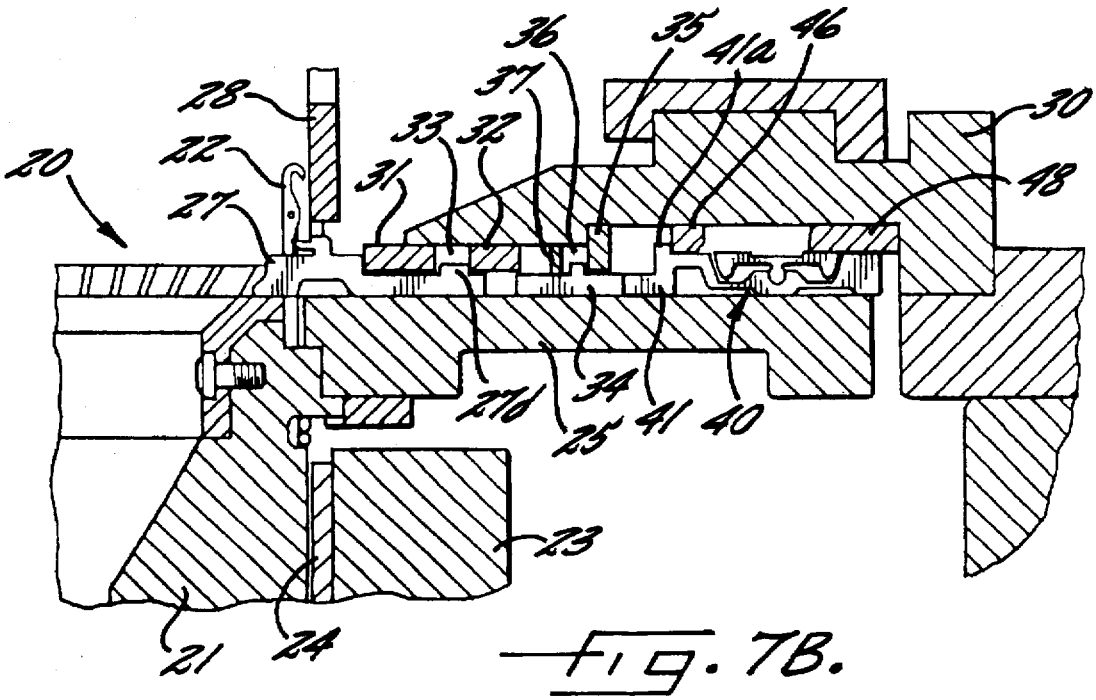
FIG. 7B is a view similar to FIG. 7A showing the pattern control mechanism in non-pile selection.

An intermediate member 34 is disposed in each sinker groove in sinker cap 25 outwardly of sinker 27 (FIG. 4). Intermediate member 34 has a butt **34*a* thereon which has a first vertical edge 34*b* and a second vertical edge 34*c* (FIG. 1). A first intermediate cam 35 is mounted on cam block 30 adjacent cam 32 and has a first side edge 35*a* which cooperates with side edge 32*b* to define a cam track 36. Cam track 36 receives butt 34*a* on intermediate member 34 and controls and moves intermediate member 34 by engagement of side edge 32*b* with vertical edge 34*b* and side edge 35*a* with vertical edge 34*c* (FIG. 1). A second intermediate cam 37 is disposed in cam track 36 and has a first side edge 37*a* and a second side edge 37*b*. Side edge 37*a*** has a first sloped or angled section $37a_1$, and a second straight section $37a_2$.

Side edge 37b of cam 37 is straight and parallel to side edge 35a of cam 35. Cam 37 divides cam track 36 into two branches 36a and 36b. If butt 34a on intermediate member 34 is caused to follow branch 36a of cam track 36, side edge 37a of cam 37 engages vertical edge 34c of butt 34a and moves intermediate member 34 into contact with sinker 27 and moves sinker 27 further toward the needles 22. Such movement brings the nose 27g of sinker 27 into operative position to form pile loops over top edge 27h. Thereafter, side edge 32b returns intermediate member 34 back to its retracted position which corresponds to branch 36b of cam track 36.

Figure 12:
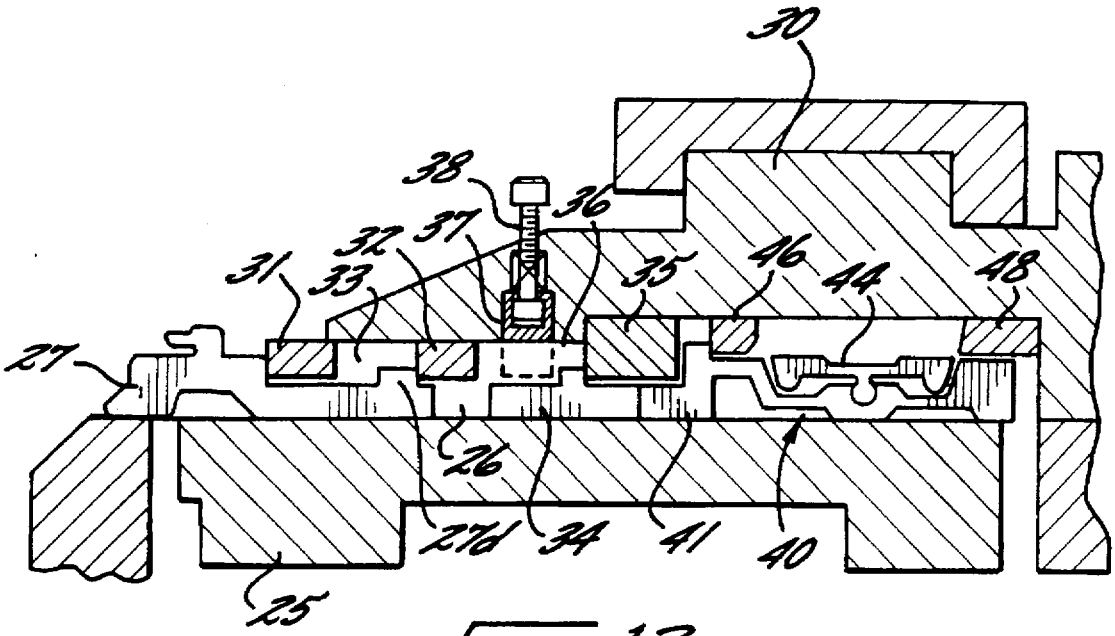
FIG. 12 is a perspective view illustrating a sinker for making high and low pile in a knit fabric.
Figure 13:
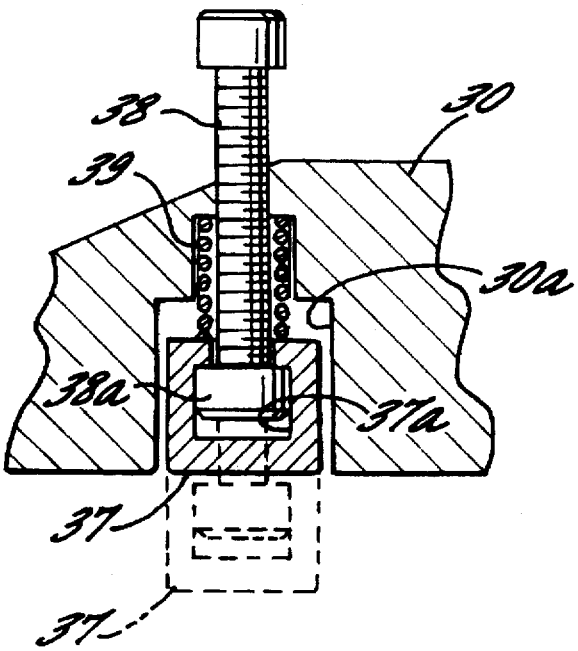
FIG. 13 is an enlarged detail of the intermediate cam shown in FIG. 12.

The second intermediate cam 37 is preferably mounted on cam block 30 for movement between an extended, operative position and a retracted, inoperative position (FIGS. 12 and 13). Accordingly, cam block 30 is provided with a recess 30a into which an inner end 38a of a threaded operating member 38 extends. Cam 37 is mounted on the inner end 38a of operating member 38 by receiving this inner end 38a in a cavity 37c in cam 37. Cavity 37c is larger than the inner end 38a of operating member 38 such that cam 37 may move a predetermined amount longitudinally or axially of operating member 38. A coil spring 39 is positioned around operating member 38 between cam 37 and the bottom of recess 30a to bias cam 37 toward the inner end of operating member 38 and toward its operative position. Thus, cam 37 protects the butt 34a from damage from outside forces which may act thereon.

A rocker bar supporting member 40 (FIG. 2) is slidably mounted in each sinker groove 26 outwardly of intermediate member 34. Rocker bar supporting member 40 includes an inner end section 41, the lower portion of which is received in sinker groove 26 and the upper portion of which includes a butt 41a. Butt 41a includes a first vertical edge 41b and a second vertical edge 41c.

Rocker bar supporting member 40 includes a medial section 42 having a central portion 42a and opposite end portions 42b and 42c. The lower portion of central portion 42a is received in sinker groove 26 and the upper portion of which has a recess or socket 42d therein. Opposite end portions 42b and 42c of medial section 42 are of less height than central portion 42a such that the top edges thereof are recessed below the top edge of the central portion 42a. Finally, rocker bar supporting member 40 includes an outer end section 43, the lower portion of which is received in sinker groove 26.

A rocker bar 44 is mounted on the medial section 42 of rocker bar supporting member 40 for pivotal movement by a circular pivot protrusion 44a which is received in socket 42d. Rocker bar 44 has symmetrical opposite end portions 44b and 44c which are beveled, wedge-shaped at their outer extremities at 44d and 44e. The lower portions of opposite end portions 44b and 44c are bulbous-shaped and serve to engage the upper edges of end portions 42b and 42c of medial section 42 of rocker bar supporting member 40 to limit the pivotal movement of rocker bar 44. The upper sections 44f and 44g of end portions 42b and 42c are magnetically attractable and are raised above the central portion of rocker bar 40.

A rocker bar supporting member cam 46 is carried by cam block 30 adjacent cam 35. Cam 46 has a side edge 46a which is straight and spaced from a second side edge 35b of cam 35 to define therewith a cam track 47 which receives and controls butt 41a on rocker bar supporting member 40. Cam 35 has a concave section 35c in its second side edge 35b corresponding to the location of second intermediate cam 37.

Cam 46 has a second side edge 46b which is positioned to engage wedge-shaped end 44d of rocker bar 44 when rocker bar 44 is pivoted to have end portion 44b extended to maintain the rocker bar 44 and rocker bar supporting member 40 in the inactive, retracted position. A rocker bar actuating cam 48 is mounted on cam block 30 and has a side edge 48a spaced from side edge 46b a distance equal to the length of rocker bar 44. Side edge 48a engages the wedge-shaped end 44e when rocker bar 44 is pivoted to position end portion 44c in extended position. Cam 48 has a protruding portion 48b in side edge 48a in alignment with and of the same shape as the concave section in side edge 35b of cam 35. The protruding portion 48b preferably has a trapezoidal-shaped cross section corresponding to the wedge-shape of the end 44e of rocker bar 44.

Upstream of protruding portion 48b of cam 48, a cancelling cam 49 is positioned above the path of travel of rocker bar 44 and includes an upwardly and outwardly sloped surface 49a to engage a pivoted or tilted rocker bar 44 and cam rocker bar 44 back to a level or neutral position. Cancelling cam 49 will function irrespective of the direction in which rocker bar 44 is pivoted.

A magnetic attraction selection device, generally indicated at 50, is positioned immediately downstream of cancelling cam 49 and above the path of travel of rocker bar 44 such that the rocker bar 44 on the rocker bar supporting member 40 passes closely therebeneath. Selection device 50 is positioned upstream of protruding portion 48b of cam 48.

Selection device 50 includes two magnetic attraction means 51 and 52 (FIGS. 2 and 3) disposed in position to attract magnetically the magnetic attractable sections 44f and 44g, respectively, of rocker bar 44 when rocker bar 44 passes therebeneath. Preferably, magnetic attraction selection device 50 comprises a permanent magnet 53 in the center and first and second electromagnets 54 and 55 on opposite sides thereof, which define the magnetic attraction means 52. Permanent magnet 53 and electromagnets 54 and 55 are all supported by a support member 56. Preferably, the outer tip 53a of permanent magnet 53 has a mushroom-shaped cross section for reasons to be described presently.

Electromagnets 54 and 55 include first and second exciting coils 54a, 55a on opposite sides of permanent magnet 53 and first and second cores 54b, 55b inside and extending to the left and right, respectively, of the coils 54a, 55a. The outer tips 54c, 55c of the cores 54b, 55b are slanted upwardly and outwardly from the inside to the outside to accommodate sufficient pivotal movement of rocker bar 44 without contact with these tips 54c, 55c. Also preferably, the magnetically attractable sections 44f and 44g of rocker bar 44 slant downwardly and outwardly for this same reason.

Figure 3:
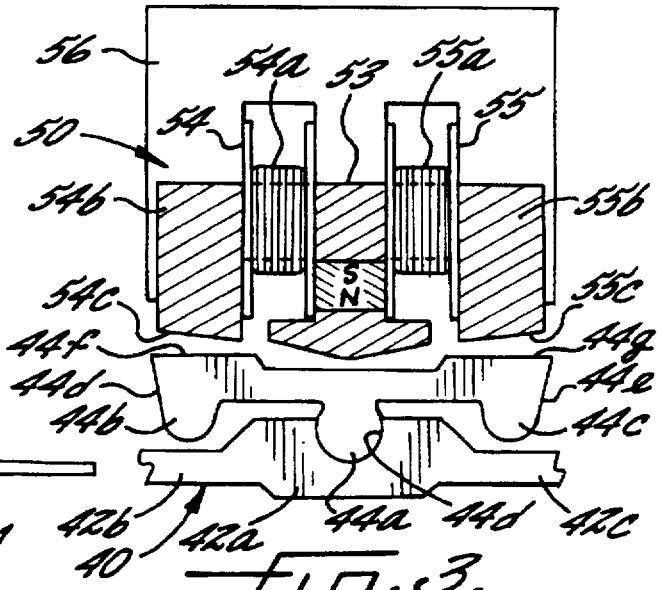
FIG. 3 is a fragmentary elevational view of the rocker bar and the electromagnetic selection device shown in FIG. 2.
Figure 3A:
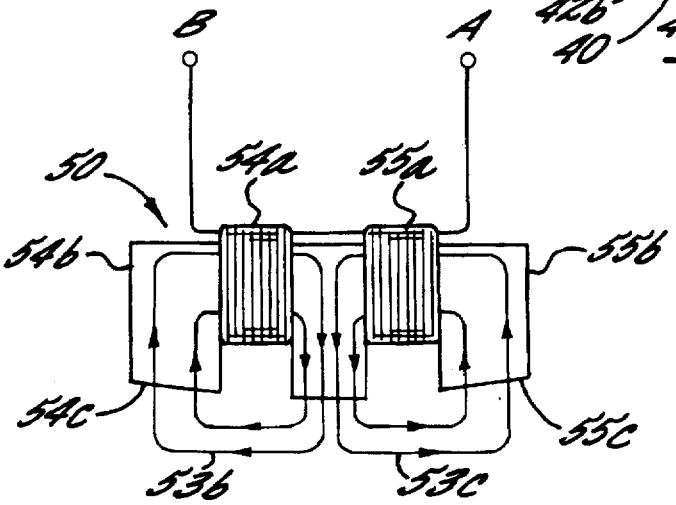
FIG. 3A is a schematic view of the electromagnetic selection device and the wiring diagram therefor.

The coils 54a, 55a are connected in series (FIGS. 3 and 3A). By applying positive or negative voltage to the electromagnets 54, 55, the tips 54c, 55c selectively attract magnetically attractable sections 44f, 44g of rocker bar 44. For example, when positive voltage is applied from A to B (FIG. 3A), the first magnetic field 53b of the permanent magnet 53 is cut-off or cancelled by the magnetic flux generated by the first electromagnet 54. At the same time, the magnetic flux generated by the second electromagnet 55 and the cut-off or cancelled first magnetic field of permanent magnet 53 enhance the second magnetic field 53c of the permanent magnet 53, thereby resulting in a stronger magnetic field. This stronger magnetic field causes the tip 55c of the core 55b to attract magnetically the magnetically attractable section 44g of rocker bar 44. Such attraction pivots rocker bar 44 to move wedge-shaped end 44e into contact with side edge 48a of cam 48.

When a negative voltage is applied from A to B, the opposite electromagnetic reaction occurs, in that the second magnetic field 53c of permanent magnet 53 is cut-off or cancelled by the magnetic flux of electromagnet 55 and the first magnetic field 53b of permanent magnet is enhanced by the magnetic flux of electromagnet 54 and by the cut-off second magnetic field 53c of permanent magnet 53. Such magnetic field causes the first electromagnet 54 to attract the magnetically attractable section 44f of rocker bar 44 to move wedge-shaped end 44d into engagement with side edge 46b of cam 46.

Figure 10:
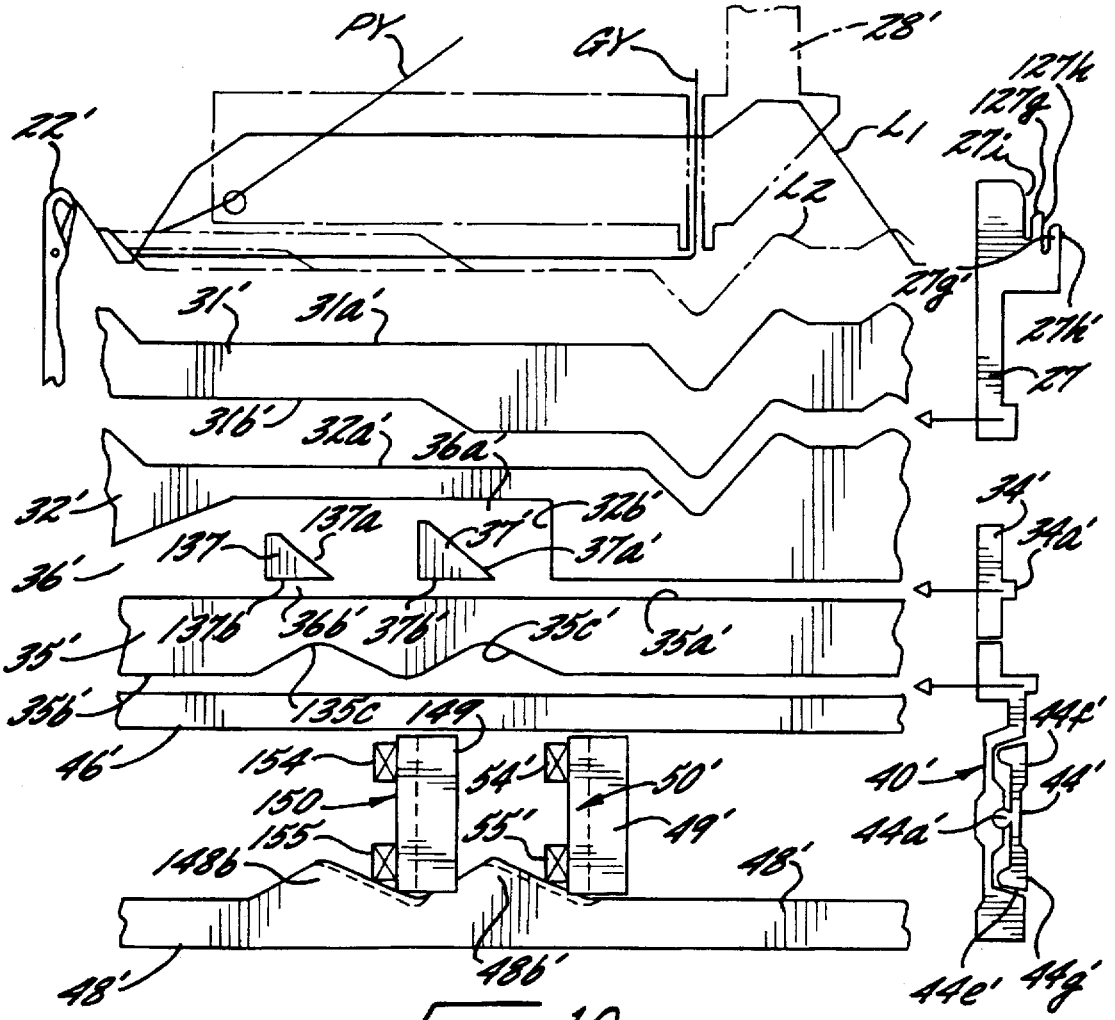
FIG. 10 is a reduced schematic view similar to FIG. 1 illustrating another embodiment of the present invention for forming high and low pile in a knit fabric.
Figure 11:
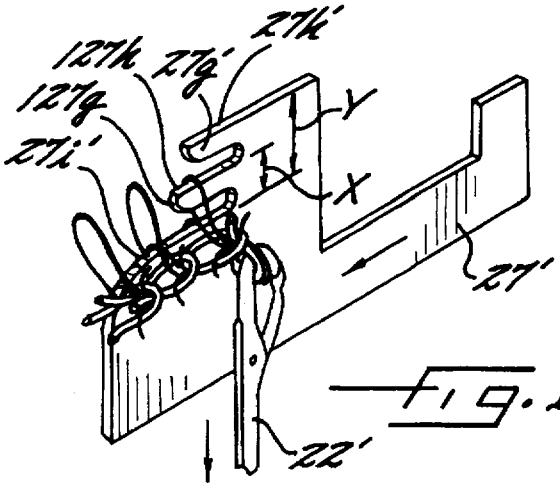

Referring now to FIGS. 10 and 11, there is illustrated another embodiment of the present invention in which like elements are referred to by like reference characters with the prime notation added. In accordance with this embodiment, sinker 27' has a first nose 27g' defining a first top edge 27h' for forming high pile loops. Sinker 27' also has a second nose 127g between the first nose 27g' and the second top edge 27i' and defining a third or intermediate top edge 127j for forming low pile loops.

Sinker cam 31' has a top edge 31a' and a bottom edge 31b'. Intermediate cam 32' has a top edge 32a' and a bottom edge 32b'. A second intermediate cam 37' is provided between side edges 32b' and 35a' of cam 35' in cam track 36' to divide cam track 36' into a first branch 36a' and a second branch 36b' for forming high pile loops. A third intermediate cam 137 is mounted in cam track 36' downstream of second intermediate cam 37' for forming low pile loops. Third intermediate cam 137 has a first side edge 137a and a second side edge 137b which are spaced apart a lesser distance than the side edges 37a' and 37b' of second intermediate cam 37'.

Rocker bar actuating cam 48' has a first protrusion 48b' in alignment with second intermediate cam 37' and a second protrusion 148b downstream thereof in alignment with third intermediate cam 137. Similarly, cam 35' has a first concave section 35c' and a second concave section 135c.

A first magnetic selection device 50' is provided upstream of protrusion 48b' for attracting selectively the magnetically attractable sections 44f' and 44g' of rocker bar 44'. A second magnetic selection device 150 is mounted between protrusions 48b' and 148b. Second magnetic selection device 150 is of the same construction as first magnetic selection device 50' and therefore will not be described again. Cancelling cams 49' and 149 are provided upstream of the first and second magnetic selection devices 50' and 150, respectively.

Figure 14:
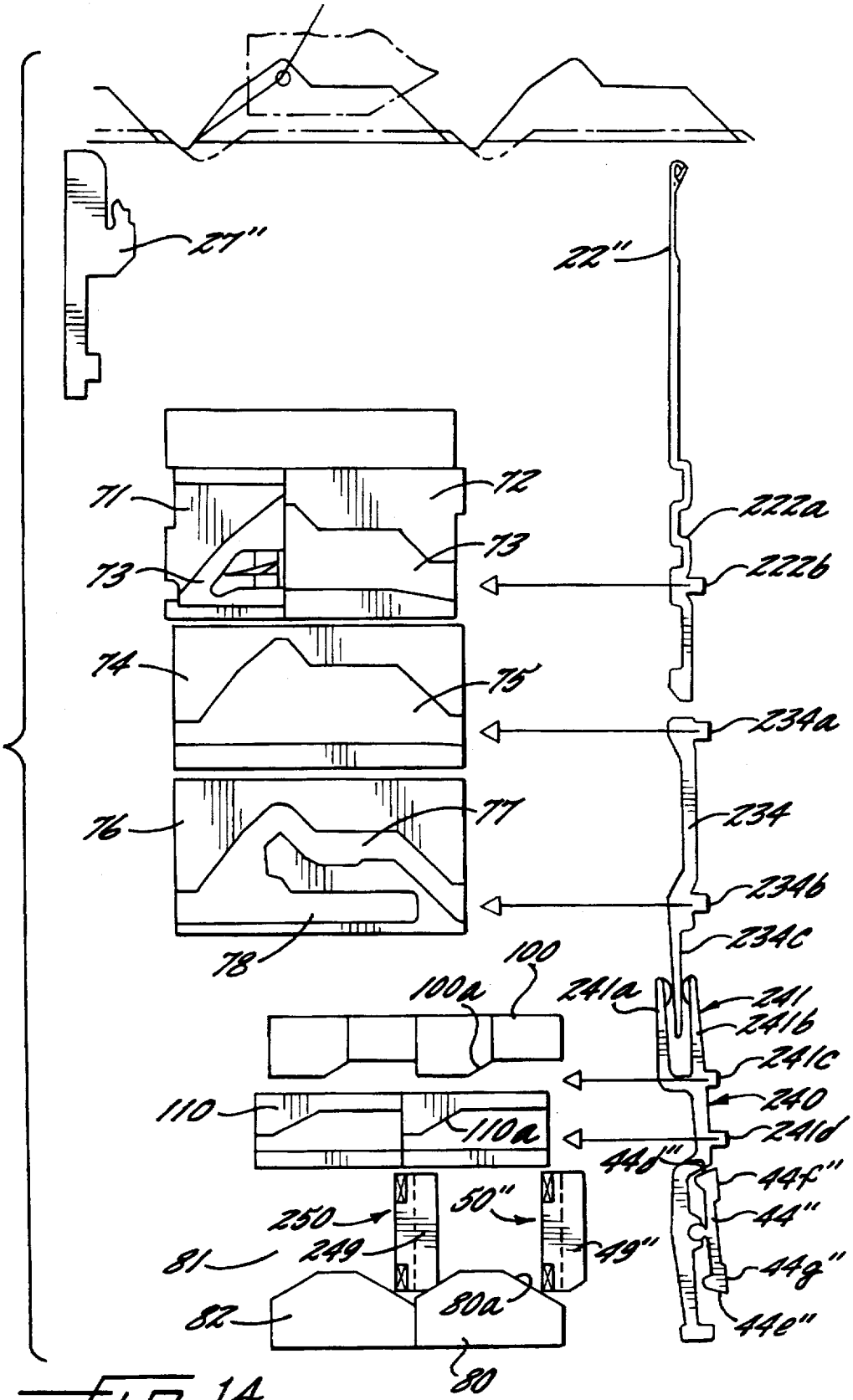
FIG. 14 is a schematic view similar to FIG. 1 of a further embodiment of the present invention showing the pattern control mechanism for controlling knitting needles.
Figure 15:
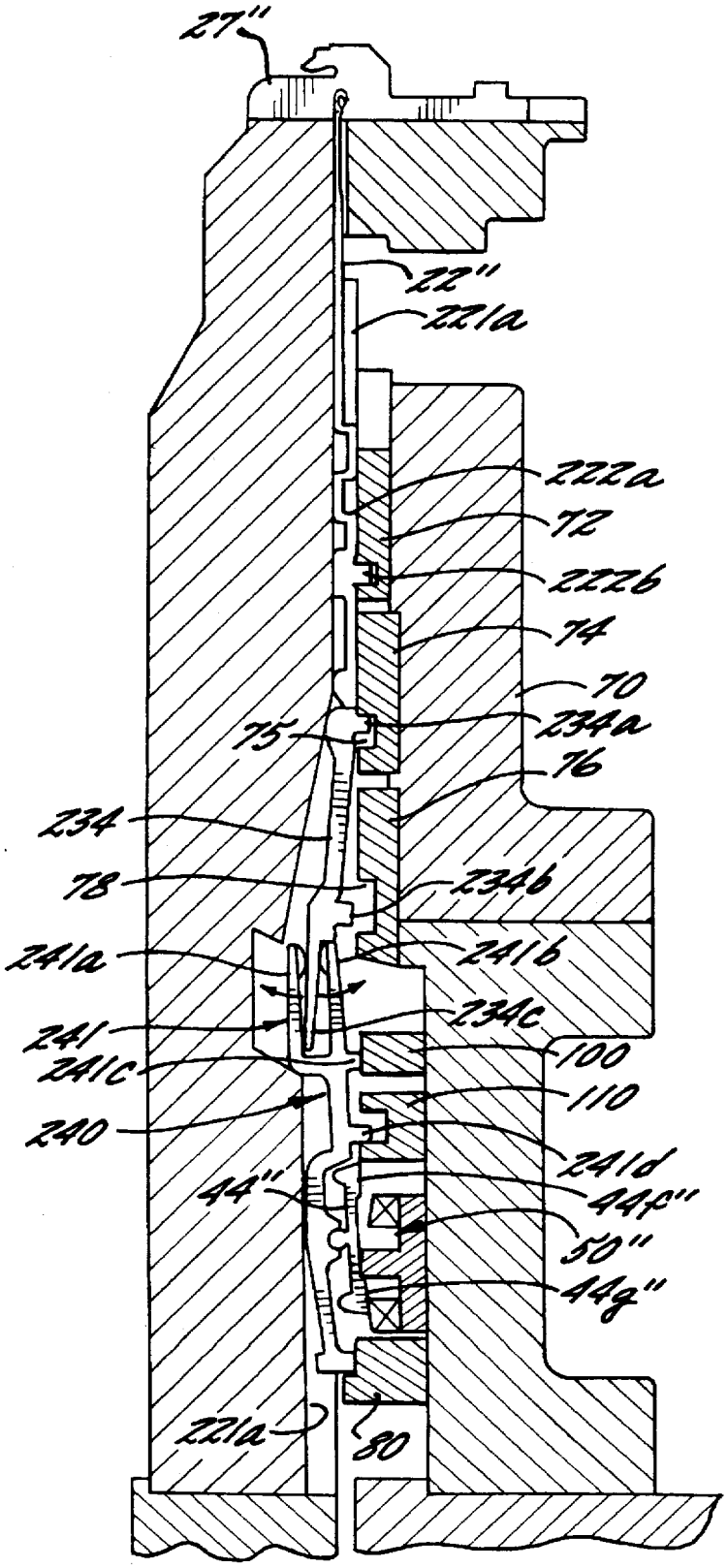
FIG. 15 is a fragmentary vertical sectional view showing the mechanism shown in FIG. 14.

Referring now to FIGS. 14 and 15, there is illustrated a further embodiment of the present invention in which like elements are referred to by like reference characters with the double prime notation added. A circular knitting machine 20" is illustrated with a needle cylinder 21" having a multitude of grooves 221a in the periphery thereof. A knitting needle 22" is slidably mounted in each groove 221a and coacts with a sinker 27" to form stitch loops which combine to form a knit fabric, as described herein a jacquard pile fabric. Needle 22" has a shank 222a with a butt 222b protruding therefrom. A pair of needle operating cams 71 and 72 mounted on a cam holder 70 define a cam track 73 which moves needle 22" up and down in the conventional manner.

An intermediate jack member 234 is slidably mounted in groove 221a in cylinder 21" beneath needle 22". Intermediate jack member 234 has an upper butt 234a adjacent the upper end thereof and a lower butt 234b at a medial portion thereof beneath the upper butt 234a. Intermediate member 234 includes an extension or tail 234c beneath the lower butt 234b. A first intermediate cam 74 defines a cam track 75 which receives upper butt 234a on intermediate jack member 234. A second intermediate cam 76 defines a first cam tract 77 and a second cam track 78. Cam track 77 receives the lower butt 234b when needle 22" is selected for movement upwardly to the knitting position and cam track 78 receives the lower butt 134b when needle 22" is to be maintained in the welt position.

A rocker bar supporting member 40 is mounted for sliding movement in groove 221a of cylinder 21" for lateral movement to control the action of intermediate jack member 234. Rocker bar supporting member includes a bifurcated upper end portion 241 which has opposed legs 241a, 241b which receive the extension or tail 234c of intermediate jack member 234 therebetween. Upper end portion 241 has a first butt 241c thereon and a second butt 241d spaced beneath the first butt 241c.

A first rocker bar supporting member operating cam 80 defines a cam track 81 which receives butt 241c for controlling the upper portion of rocker bar supporting member 240. A second cam 82 defines a cam track 83 which receives and controls butt 241d.

A medial section 242 of rocker bar supporting member 240 includes a socket 242d for pivotally mounting a rocker bar 44". Rocker bar 44" has a circular protrusion 44a" mounted in socket 242d and has magnetically attractable section 44f" and 44g". Rocker bar 44" also has wedge-shaped ends 44d" and 44e".

A rocker bar actuating cam 80 defines a cam track 81 for receiving and controlling rocker bar 44". A cancelling cam 49" is disposed adjacent the entrance to cam track 81 to engage and position rocker bar 44" level or in neutral position.

A first magnetic selection device 50" is mounted upstream of cam track 81 and immediately downstream of cancelling cam 49" and beside the path of travel of rocker bar 44". First magnetic selection device 50" includes magnetic attraction means 51" and 52" for attracting selectively the magnetically attractable sections 44f" and 44g" of rocker bar 44". A second magnetic device 250 may be placed downstream from first magnetic selection device 50" should it be desired to further control needle 22", such as to move the same to a tucking position. Of course, second magnetic selection device 250 should be preceded by a second cancelling cam 249, and should be followed by a second cam 82.

Figure 16:
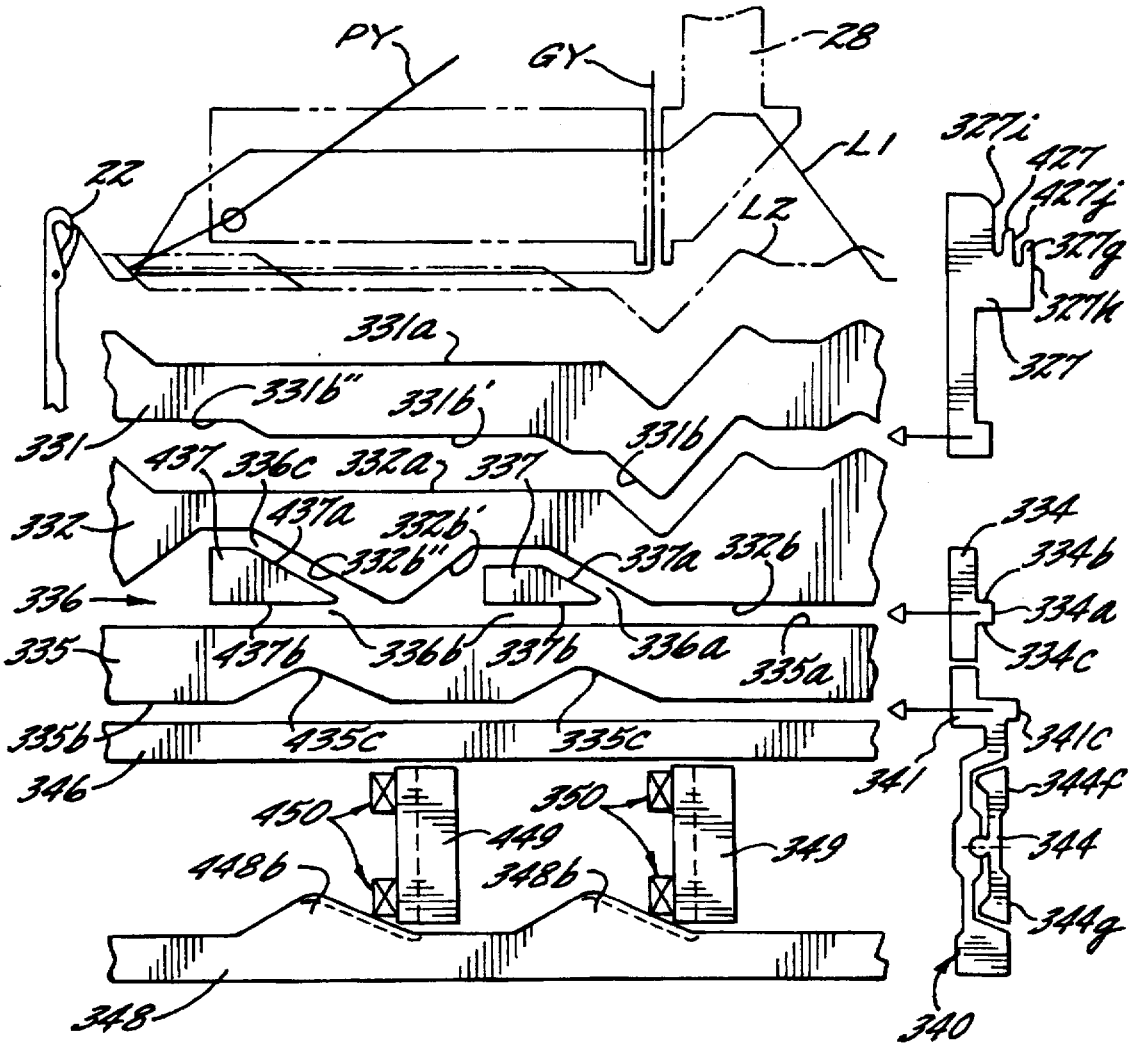
FIG. 16 is a schematic view similar to FIG. 10 of a still further embodiment of the present invention for forming high and low pile in a knit fabric.

Referring now to FIG. 16, there is illustrated still another embodiment of the present invention in which like elements are referred to by similar reference characters in which the last two digits are the same as previous reference characters in FIG. 10 preceded by the prefixes "3" or "4". In accordance with this embodiment, sinker 327 has a first nose 327g defining a first top edge 327h. Sinker 327 has a second nose 427g between the first nose 327g and the second top edge 327i and defining a third or intermediate top edge 427j for forming low pile loops.

Sinker cam 331 has a top edge 331a and a bottom edge 331b. First intermediate cam 332 has a top edge 332a and a bottom edge 332b. A second intermediate cam 337 is provided between bottom edge 331b of cam 331 and a top edge 335a of cam 335 in cam track 336 to divide cam track 336 into a first branch 336a for forming low pile loops and a second branch 336b for forming no pile loops. A third intermediate cam 437 is mounted in cam track 336 downstream of second intermediate cam 337 and has a first edge 437a for forming high pile loops and a second edge 437b for forming no pile loops. Third intermediate cam 437 divides cam track 336 into a third branch 336c and a continuation of second branch 336b.

The bottom edge 331b of sinker cam 331 has a second 331b' which extends from a point in vertical alignment with the top of the upwardly inclined portion of top edge 337a of second intermediate cam 337 to a point overlying the middle of the upwardly inclined portion of top edge 437a of third intermediate cam 437. This section 331b' engages the forward edge 327e of sinker butt 327d to control positively the sinker 327 to prevent sinker 327 from advancing further than is necessary for low pile formation until the same is forcibly advanced by third intermediate cam 437. Bottom edge 331b has a section 331b" which permits such forcible advancement of sinker 327 by third intermediate cam 437.

Similarly, the bottom edge 332b of first intermediate cam 332 inclines downwardly immediately downstream of second intermediate cam 337 as indicated at 332b' and then upwardly at third intermediate cam 437 as indicated at 332b". The bottom edge 332b engages the forward edge 334b of butt 334a on intermediate jack member 334 to control positively any advancing movement of the intermediate jack member 334 due to engagement of the rear edge 334c of butt 334a with second intermediate cam 337 or third intermediate cam 437.

Cam 335 has a bottom edge 335b which has a first concave section 335c therein in alignment with second intermediate cam 337 and a second concave section 435c in alignment with third intermediate cam 437. These concave sections 335c and 435c permit advancement of rocker bar supporting member 341 and then positively retracts rocker bar supporting member 341 by engaging butt 341a thereof.

Cam 348 has a first protrusion 348b in alignment with second intermediate cam 337 and a second protrusion 448b in alignment with third intermediate cam 437. A first magnetic selection device 350 is provided upstream of protrusion 348b for attracting selectively sections 344f and 344g of rocker bar 344. A second magnetic selection device 450 is mounted between protrusions 348b and 448b for attracting selectively sections 344f and 344g of rocker bar 344. Cancelling cams 349 and 449 are provided upstream of the first and second magnetic selection devices 350 and 450, respectively.

The operation of the various embodiments will now be described. When sinker 27 is to be advanced, a signal from a controller (not shown) is sent to the magnetic selection device 50 to cause electromagnet 55 to attract magnetically attractable section 44g of rocker bar 44 (FIG. 3) to pivot rocker bar 44 and move wedge-shaped end 44e into extended position. By this time, ground yarn GY is supplied from yarn carrier 28 and crosses over top edge 27i of sinker 27 and is fed to the knitting needle 22.

As rocker bar 44 moves with rotating sinker cap 25, wedge-shaped end 44e engages the protrusion 48b of cam 48 and rocker bar 44 and rocker bar supporting member 40 are pushed inwardly toward the cylinder 21. Rocker bar supporting member 40 engages and pushes inwardly intermediate member 34 such that butt 34a engages the inwardly slanting section $37a_1$ of side edge 37a of second intermediate cam 37 which pushes intermediate member 34 even further inwardly toward cylinder 22.

Figure 8A:
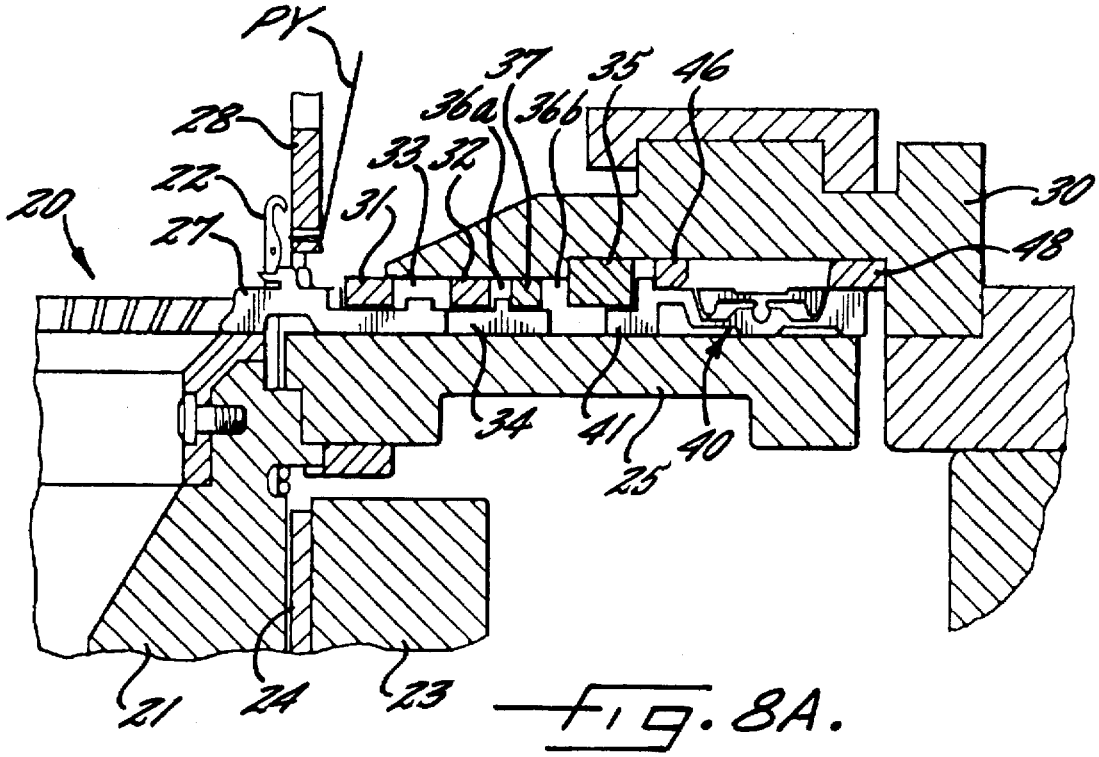
FIG. 8A is a fragmentary sectional view taken substantially along line 8—8 in FIG. 1 showing the pattern control mechanism in pile forming selection.
Figure 8B:
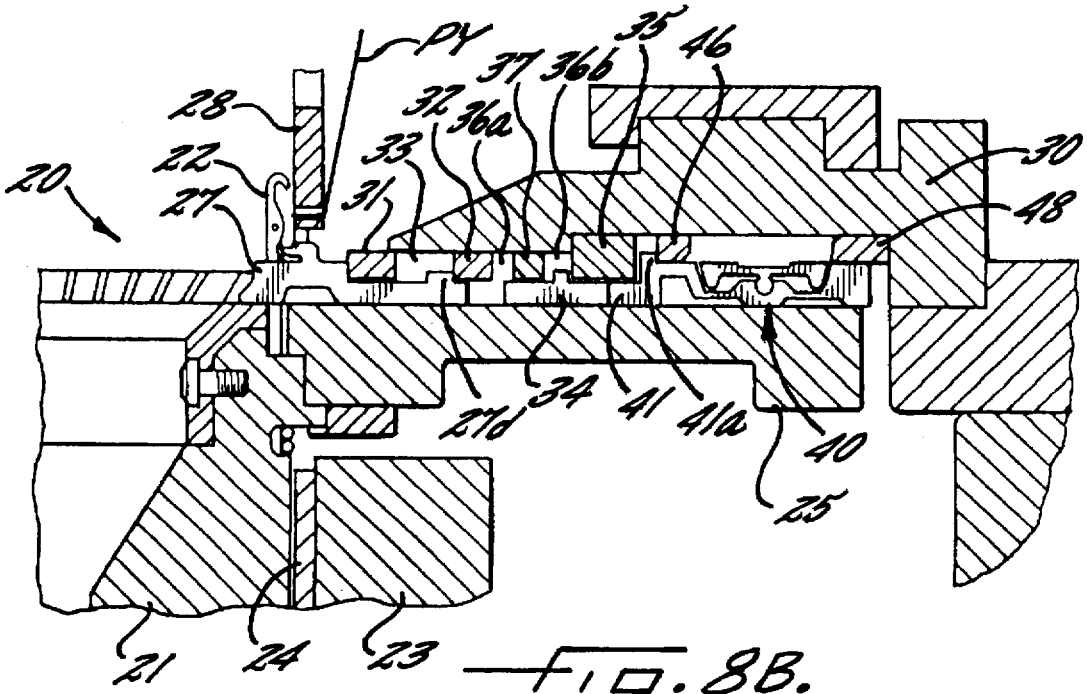
FIG. 8B is a view similar to FIG. 8A showing the pattern control mechanism in non-pile selection.
Figure 9:
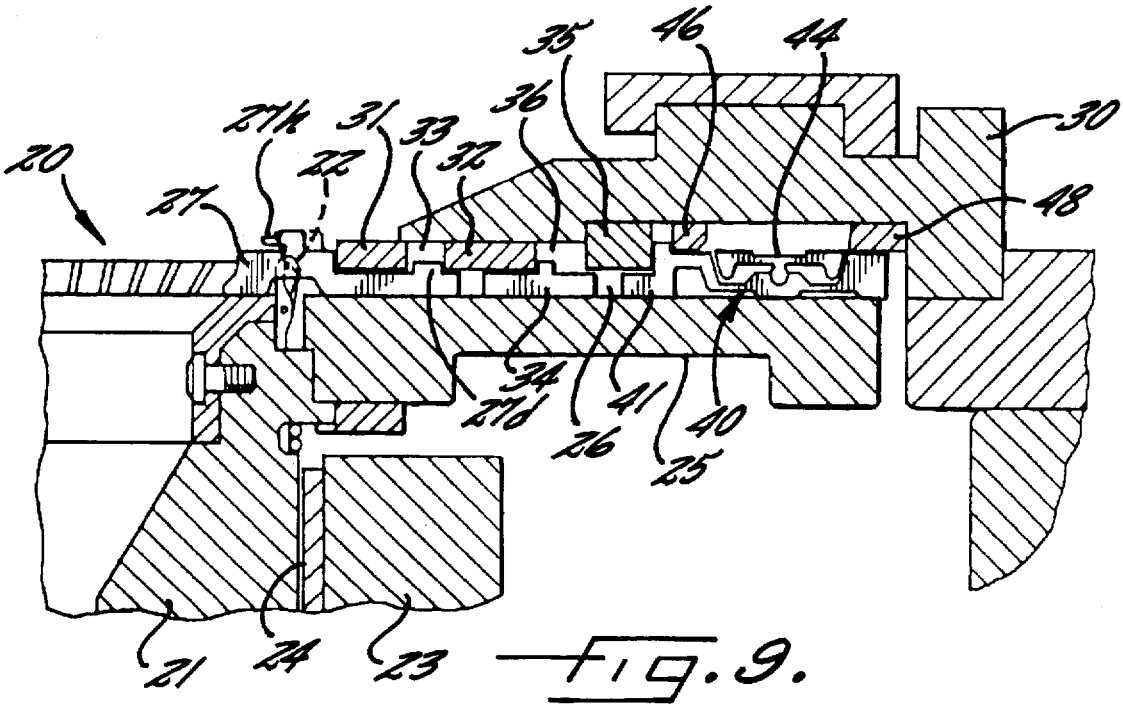
FIG. 9 is a fragmentary sectional view taken substantially along line 9—9 in FIG. 1.

Intermediate member 34 engages sinker 27 and advances sinker 27 to its most extended inward position in which nose 27g is in position to receive pile yarn PY from yarn carrier 28 across the top edge 27h thereof to form a pile loop in concert with needle 22 (FIGS. 8A and 9). When butt 34a reaches the straight section $37a_2$ of side edge 37a of second intermediate cam 37, the tip of nose 27g of sinker 27 is preferably at least 0.3 mm inward from the circumferential action line $L_1$ (FIG. 1) of the knitting needle 22. Therefore, formation of a pile loop at least 0.3 mm from the tip of nose 27g is ensured and will prevent such pile loop from prematurely slipping off of top edge 27h of sinker 27.

While intermediate member 34 is being pushed further out by second intermediate cam 37, butt 41a on rocker bar supporting member 40 engages the outwardly slanting portion of concave section 35c of first intermediate cam 35 which returns rocker bar supporting member 40 and thus rocker bar 44 to their original retracted positions. Of course, it is possible to omit intermediate member 34 and have rocker bar supporting member 40 act directly on sinker 27. Suitable modification of the cam system would be required.

When sinker 27 is not to be advanced, a signal is sent to electromagnet 54 so as to attract magnetically attractable section 44f of rocker bar 44 to pivot rocker bar 44 to extend wedge-shaped end 44d. Rocker bar 44 does not engage rocker bar actuating cam 48 and therefore rocker bar 44 and rocker bar supporting member 40 do not move inwardly in groove of sinker cap 25. Consequently, intermediate member 34 is not pushed inwardly and butt 34a thereon remains in branch 36b of cam track 36. Sinker 27 is thus only controlled by cam track 33 and both the pile yarn and ground yarn GY are fed to needle 22 and form ground stitch loops across second top edge 27i of sinker The action line $L_2$ (FIG. 1) shows the action of sinker 27 forming pile and non-pile loops in the knitted fabric.

In the foregoing manner, the circular knitting machine 20 forms a figured jacquard pile fabric having pile and non-pile areas based on the pattern signal output by the controller (not shown). For convenience, the action line $L_1$ of needle 22 shows movement of needle 22 only between the welting and knitting positions. However, it is contemplated that needle 22 may be moved between three positions—knitting, tucking and welting—by a known needle selection device. Also, the cams 31, 32, 35, 46 and 48 are illustrated as units formed in a straight line. It is contemplated, however, that such cams may be formed by multiple cam segments if it is more convenient.

In the sinker embodiment illustrated in FIGS. 10 and 11, the sinker 27' has three operative positions. The first of these positions is the high pile forming position; the second position is the low pile forming position; and the third position is the ground loop or non-pile forming position. To move sinker 27' to the first position, a signal is sent to electromagnet 55' to attract magnetically attractable section 44g' of rocker bar 44' to pivot rocker bar 44' Wedge-shaped end 44e' engages the first protrusion 48b' of cam 48' and moves the rocker bar 44' and rocker bar supporting member 40' inwardly. Rocker bar supporting member 40' moves intermediate member 34' inwardly to cause butt 34a' thereon to engage second intermediate cam 37' and move sinker 27' to its innermost position. Pile yarn PY will be fed to needle 22' across top edge 27h' of nose 27g' to form a high pile loop.

Meanwhile, butt 41a' on rocker bar supporting member 40 engages the outwardly slanting portion of concave section 35c' of side edge 35b' of cam 35 to return rocker bar supporting member 40' to its original position. Rocker bar 44' passes under second cancelling cam 149 which returns rocker bar 44' to its neutral position.

When low pile is to be formed, a signal is sent to second magnetic selection device 150 and particularly to electromagnet 155 to attract section 44g' of rocker bar 44'. Wedge-shaped end 44e' then engages second protrusion 148b of cam 48' to push rocker bar supporting member 40' inwardly to cause butt 34a' on intermediate member 34' to engage third intermediate cam 137. Third intermediate cam 137 pushes sinker 27' to its second position such that second nose 127*g* receives pile yarn PY on second top edge 127*g* thereof to form low pile loops.

When non-pile loops are to be formed, signals are sent to electromagnets 54' and 154 to attract section 44*f'* of rocker bar 44'. Rocker bar 44' thus passes protrusions 48*b'* and 148*b* and rocker bar supporting member 40' and intermediate member 34' are not pushed inwardly. Sinker 27' is thus controlled only by cams 31' and 32' and forms only ground or non-pile loops across top edge 27*i'* of sinker 27'

The sinker embodiment illustrated in FIG. 16 operates virtually the same as the embodiment illustrated in FIGS. 10 and 11 except that sinker 327 is controlled positively at all times. Accordingly, the operation of this embodiment will not be described further.

The jacquard pattern control mechanism of the present invention is not limited to making jacquard pile fabrics. Such control mechanism can be used to control selectively knitting instrumentalities, such as sinkers, cylinder needles, dial needles and jacks, etc. to at least two different paths.

In the embodiment illustrated in FIGS. 14 and 15, needle 22" may be moved between at least two positions, i.e., welting and knitting positions. When needle 22" is not to be raised, but is to be maintained in the welting position, a signal is sent to electromagnet 55" of magnetic selection device 50" to attract section 44*g"* of rocker bar 44". Wedge-shaped end 44*e"* of rocker bar 44" is moved to extended position and engages the upwardly inclined surface 80*a*, which has a trapezoidal cross section, of cam 80 to raise rocker bar supporting member 240 upwardly. Butt 241*c* of rocker bar supporting member 240 engages cancel cam 100 immediately below the bifurcated end 241 of rocker bar supporting member 240 and bifurcated end 241 is pushed outwardly by the slanting portion 100*a* of cam 100.

Bifurcated end 241 pushes out extension 234*c* of intermediate member 234. Butt 234*b* on intermediate member 234 does not enter cam track 77 of cam 76 but passes thereby and does not move upwardly. Accordingly, needle 22" remains in the welting position.

After rocker bar 44" passes the summit 80*b* of cam 80, butt 241*d* of rocker bar supporting member 240 engages a downward slanting section 110*a* of an intermediate cam 110, thus returning rocker bar supporting member 240 to its original position. The extension 234*c* of intermediate member 234 returns to its original position and butt 234*b* enters cam track 78 on cam 76.

To raise knitting needle 22", a signal is sent to electromagnet 54" so as to attract section 44*f"* of rocker bar 44" Rocker bar 44" thus passes beside section 80*a* of cam 80 and is not raised upwardly. Butt 241*c* does not engage cancelling cam 100 and extension 234*c* is not pushed outwardly. Therefore, butt 234*b* enters cam track 77 and intermediate member 234 is raised upwardly by cam 76 and knitting needle 22" is raised to the knitting position.

If desired, needle 22" can be raised to a tucking position. In such event, second magnetic attraction device 250 is provided, as is second cam 82.

According to the present invention, the bevelled wedge-shaped ends of the rocker bar 44, 44' or 44" firmly engage the rocker bar operating cams 48, 48' or 80 which have a trapezoidal-shaped cross section. Therefore, the rocker bar 44, 44' or 44" does not come off of the cam 48, 48' or 80 thereby ensuring control with no selection errors. Furthermore, the rocker bar 44, 44' or 44" is free of protruding butts, thereby reducing the possibility of breakage of a butt even when there is a selection error.

In addition, at the point where the sinker 27 or 27' changes direction, the vertical edges 27*c* and vertical edge 27*e* are held by the side edges of cam Accordingly, it is possible to run the circular knitting machine 21 with a jacquard pattern as a knitting machine producing a non-patterned fabric.

Furthermore, the magnetic attraction devices 50, 50' 150, 50" and 250 can be small and fit into very limited spaces because only the rocker bar 44, 44' or 44" is being controlled. Accordingly, the production of a wide variety of jacquard patterns under computer control can now be accomplished.

In the drawings and the specification, there has been set forth preferred embodiments of the invention and, although specific terms are employed, the terms are used in a generic and descriptive sense only and not for the purpose of limitation, the scope of the invention being set forth in the following claims.

That which is claimed is:

1. In a circular knitting machine having knitting instrumentalities for forming knit fabric including a rotating member having a plurality of grooves in which said knitting instrumentalities are slidably mounted, the improvement comprising control means for controlling said knitting instrumentalities to produce jacquard knit fabric, said control means comprising a plurality of rocker bar supporting members each slidably mounted in one of the grooves along with one of said knitting instrumentalities, each of said plurality of rocker bar supporting members including at least one butt protruding therefrom, a plurality of elongate rocker bars formed free of butts and having magnetically attractable opposite end portions and each being pivotally mounted on one of said plurality of rocker bar supporting members for movement about a medial pivot, the opposite end portions of said elongate rocker bar being selectively movable between operative and inoperative positions, magnetic attracting means operatively associated with the opposite end portions of said elongate rocker bars for selectively attracting one of said magnetically attractable opposite end portions to pivot said elongate rocker bars and selectively move one of the opposite end portions to said operative position and the other of the opposite end portions to said inoperative position, rocker bar operating cam means engageable with the end portion of said rocker bar in said operative position for either moving the rocker bar and the rocker bar supporting member assembly from a retracted position to an extended position for engagement and movement said knitting instrumentality or maintaining the rocker bar and the rocker bar supporting member assembly in said retracted position, and control cam means engageable with said knitting instrumentalities for controlling said knitting instrumentalities and for moving the instrumentalities to at least one knitting position upon movement of the rocker bar supporting member to the extended position and for maintaining said knitting instrumentality in a non-knitting position when the rocker bar supporting member is in the retracted position.

2. A circular knitting machine according to claim 1 wherein said rotating member comprises a sinker cap and said knitting instrumentalities comprise sinkers.

3. A circular knitting machine according to claim 1 wherein said rotating member comprises a needle cylinder and said knitting instrumentalities comprise knitting needles.

4. A circular knitting machine according to claim 1 including an intermediate member having at least one operating butt thereon slidably mounted in each of the grooves between said knitting instrumentality and the rocker bar supporting member, and intermediate cam means for moving said intermediate member from a retracted position to an extended position.

5. A circular knitting machine according to claim 1 wherein the opposite end portions of said elongate rocker bar have a bevelled wedge shape and wherein said rocker bar operating cam means has a trapezoidal-shaped cross section.

6. A circular knitting machine according to claim 2 wherein each of said sinker has a plurality of sinker noses for forming stitch loops of different sizes and wherein said elongate rocker bar has a plurality of magnetically attractable sections at the opposite end portions for controlling the sinker to produce stitch loops of varying size.

7. A circular knitting machine according to claim 4 wherein said rotating member is a sinker cap and said knitting instrumentalities are sinkers, said sinkers having a plurality of noses for forming ground knit stitch loops and pile stitch loops.

8. A circular knitting machine according to claim 7 wherein said intermediate cam means is movable between an operative position in which said intermediate cam means is engageable by said at least one operating butt on said intermediate member to produce both pile and ground stitch loops and an inoperative position in which said intermediate cam means is positioned for non-engagement with the butt on said intermediate member to produce only ground stitch loops.

9. A circular knitting machine according to claim 3 including an intermediate jack member slidably mounted in each groove of said needle cylinder between said needle and the rocker bar supporting member, the jack having a pair of spaced apart butts thereon, said intermediate jack member being rockable so as to move one of the butts thereon between an operative position and an inoperative position, and wherein said elongate rocker bar supporting member is operatively associated with said intermediate jack member for selectively rocking said intermediate jack member between the operative and inoperative positions, and said rocker bar operating cam means includes means for selectively operating the rocker bar supporting member to rock said intermediate jack member.

10. A circular knitting machine according to claim 1 wherein said magnetic attracting means comprises an elongate permanent magnet having opposite ends and first and second electromagnets connected to the opposite ends of said elongate permanent magnet in series.

11. A circular knitting machine according to claim 10 wherein the opposite end portions of said elongate rocker bar have magnetically attractable sections which slope downwardly and outwardly from the medial portion of said elongate rocker bar.

12. A circular knitting machine according to claim 10 wherein said elongate permanent magnet has an outer tip adjacent said elongate rocker bar which has a mushroom-shaped cross section.

13. A pattern control mechanism for a circular knitting machine having knitting instrumentalities slidably mounted in grooves in at least one rotatable member, said pattern control mechanism comprising a plurality of rocker bar supporting members slidably mounted in the grooves of the rotating member with the knitting instrumentalities and each of the support members has at least one operating butt thereon, an elongate rocker bar having magnetically attractable sections at opposite end portions thereof, the rocker bar being buttless said elongate rocker bar being pivotally mounted on each of said plurality of rocker bar supporting member for movement about a medial pivot thereon, rocker bar operating cam means for moving the rocker bar and rocker bar supporting member assemblies longitudinally upon engagement with one end of said elongate rocker bar and for maintaining said elongate rocker bar in a retracted position upon engagement with the other end thereof, and magnetic attracting means operatively associated with said magnetically attractable sections at opposite end portions of said elongate rocker bar for attracting selectively the magnetically attractable sections to control the knitting instrumentalities in a predetermined pattern.

14. A pattern control mechanism according to claim 13 wherein magnetic attracting means comprises an elongate permanent magnet having opposite ends and first and second electromagnets connected to the opposite ends of said elongate permanent magnet in series.

15. A pattern control mechanism according to claim 14 wherein said elongate permanent magnet has an outer tip adjacent said elongate rocker bar which has a mushroom-shaped cross section.

16. A pattern control mechanism according to claim 14 wherein said elongate magnetically attractable sections of said elongate rocker bar slant downwardly and outwardly from the medial portion of said rocker bar.

17. A circular knitting machine according to claim 2 wherein said sinkers each have a butt thereon and wherein said control cam means defines a cam race receiving said sinker butts therein and having opposed edges contacting forward and rearward edges of the sinker butts to positively control advancing and retracting movement of said sinkers.

18. A circular knitting machine according to claim 4 wherein said knitting instrumentalities comprise sinkers and wherein said intermediate cam means positively moves said intermediate member from the extended position to the retracted position.

* * * * *